US009708811B2

(12) United States Patent
Hsieh et al.

(10) Patent No.: US 9,708,811 B2
(45) Date of Patent: Jul. 18, 2017

(54) ACOUSTIC BOARD HAVING DISPLACED AND PASSABLY ABUTTED MULTIPLE THROUGH HOLES

(71) Applicant: Gixia Group Co., Jhubei (TW)

(72) Inventors: Jung-ya Hsieh, Jhubei (TW); Yung-fu Lin, Jhubei (TW); Yuan-Hsin Chang, Jhubei (TW)

(73) Assignee: Gixia Group Co., Jhubei (TW)

( * ) Notice: Subject to any disclaimer, the term of this patent is extended or adjusted under 35 U.S.C. 154(b) by 0 days.

(21) Appl. No.: 15/058,861

(22) Filed: Mar. 2, 2016

(65) Prior Publication Data

US 2016/0265215 A1 Sep. 15, 2016

(30) Foreign Application Priority Data

Mar. 9, 2015 (CN) ..... 2015 1 0101348

(51) Int. Cl.

| | |
|---|---|
| ***E04B 1/82*** | (2006.01) |
| ***E04B 1/84*** | (2006.01) |
| ***G10K 11/16*** | (2006.01) |
| *E04B 1/74* | (2006.01) |

(52) U.S. Cl.

CPC ..... *E04B 1/8209* (2013.01); *G10K 11/16* (2013.01)

(58) Field of Classification Search

CPC ..... G10K 11/16; G10K 11/002; G10K 11/04; G10K 11/168; E04B 1/8209; E04B 1/8409

USPC ..... 181/293, 295, 292, 284, 286

See application file for complete search history.

(56) References Cited

U.S. PATENT DOCUMENTS

| | | | | |
|---|---|---|---|---|
| 1,955,479 A * | 4/1934 | Weinberger | F04D 25/14 | 181/224 |
| 2,134,495 A * | 10/1938 | Woodall | E04B 1/8409 | 181/290 |
| 2,320,668 A * | 6/1943 | Smith | F01N 1/18 | 181/277 |
| 2,645,301 A * | 7/1953 | De Vries | H04R 1/22 | 181/290 |
| 2,656,004 A * | 10/1953 | Olson | H04R 1/22 | 181/157 |
| 3,253,676 A * | 5/1966 | Bottum | F01N 1/165 | 181/241 |
| 4,189,627 A * | 2/1980 | Flanagan | H04R 1/22 | 181/151 |

(Continued)

*Primary Examiner* — Edgardo San Martin
(74) *Attorney, Agent, or Firm* — Wang Law Firm, Inc.

(57) ABSTRACT

An acoustic board having displaced and passably abutted multiple through-holes comprises an outer surface and an inner surface, in which the first through-holes formed from the outer surface toward the inner surface and the second through-holes formed from the inner surface toward the outer surface are displaced and passably abutted thereby conjunctively constituting acoustically absorptive micro-orifices. Herein at least some of the second through-holes have a cross-sectional area of greater than 1 $mm^2$ and are displaced and passably abutted to at least some of the first through-holes, thereby collectively forming a plurality of acoustically absorptive micro-orifices having a cross-sectional area of smaller than 1 $mm^2$, and, in comparison with the total area of the acoustic board, the opening rate for the sum of the cross-sectional areas of all such acoustically absorptive micro-orifices is less than 3%.

10 Claims, 8 Drawing Sheets

(56) References Cited

U.S. PATENT DOCUMENTS 5,930,371 A * 7/1999 Cheng ..... F01N 1/023 381/71.5
6,367,580 B1 * 4/2002 Chang ..... F01N 1/08 181/219
6,811,372 B1 * 11/2004 Emborg ..... F02C 7/045 181/292
7,055,484 B2 * 6/2006 Marks ..... F02B 27/0294 123/184.56
7,117,974 B2 * 10/2006 Moenssen ..... F02M 35/1216 123/184.55
7,165,647 B2 * 1/2007 Lee ..... H04R 19/04 181/158
7,257,894 B2 * 8/2007 Buge ..... B64D 33/02 29/890.01
8,316,813 B2 * 11/2012 Prior ..... F01N 1/006 123/184.53
8,485,310 B2 * 7/2013 Tanabe ..... G10K 11/172 181/224
8,573,356 B1 * 11/2013 Perdue ..... E04B 1/994 181/284
8,714,304 B2 * 5/2014 Kitamura ..... G10K 11/161 181/210
8,893,851 B2 * 11/2014 Kitamura ..... E04B 1/86 181/210
2005/0161280 A1 * 7/2005 Furuya ..... F01N 1/023 181/225
2005/0252716 A1 * 11/2005 Moenssen ..... F02M 35/1216 181/277
2006/0289229 A1 * 12/2006 Yamaguchi ..... G10K 11/172 181/290
2008/0066999 A1 * 3/2008 Kostun ..... F02M 35/1222 181/250
2008/0314679 A1 * 12/2008 Rowe ..... F01N 1/16 181/241
2010/0078258 A1 * 4/2010 Tanabe ..... G10K 11/172 181/224
2011/0155504 A1 * 6/2011 Tanabe ..... G10K 11/172 181/224
2016/0230778 A1 * 8/2016 Mekid ..... G10K 11/002

* cited by examiner

ACOUSTIC BOARD HAVING DISPLACED AND PASSABLY ABUTTED MULTIPLE THROUGH HOLES

FIELD OF THE INVENTION

An acoustic board, especially an acoustic board formed with plate materials having through-holes which are displaced and passably abutted thereby constituting acoustically abortive micro-orifices, is disclosed.

BACKGROUND OF THE INVENTION

The advancement of modern technologies also brings noises to people's living environment, which invades into our daily lives, causing restlessness and irritability thus seriously deteriorating the living quality. Especially, in current crowded metropolitans, since buildings are densely constructed and sufficient buffering space may not be available among them, sounds coming from different sources, e.g., television speakers or people's talks of nearby neighbors, may become very annoying and unbearable. With improvement on the level of living, people are gradually paying more and more attention to the comfortableness in their environments, and sound insulation materials are now comprehensively accepted and applied at various locations, such as residences, offices, music classrooms or the like. It is known that acoustic boards can be utilized as a type of sound insulation materials, whose acoustic absorption feature has been the focus of people's incessant efforts so as to ameliorate and enhance their sound elimination effect based on better structural designs.

Moreover, it is also understood that, with acoustic boards having different diameters of hole and opening rates, the sound absorption effect thereof with regards to sounds of various frequencies may correspondingly differ. Typically, although the range of human auditory sense could cover a band of approximately 20 to 20 k Hz audio frequencies, acoustic frequencies exceeding 10 k Hz may already generate poor hearing responses for general people. Consequently, to fit into human auditory senses, the sounding range of general instruments may usually locate within a span of about 20 to 4000 Hz, and the researches of the Applicants are accordingly performed based on such a band, in which a common 3270 Hz is set as the high frequency test and 880 Hz as the low frequency test for typical hearing range, and their acoustic absorption rates under six different conditions within such two frequency ranges are summarized, as hereunder shown in Table 1:

TABLE 1

| | A1 | B1 | B2 | B3 | C1 | C2 |
|---|---|---|---|---|---|---|
| Diameter of Hole (mm) | 0.2 | 0.4 | 0.69 | 1.27 | 1.73 | 1 |
| Opening Rate (%) | 1 | 1 | 3 | 10 | 3 | 1 |
| Acoustic Absorption Rate (880 Hz) | 0.994179 | 0.801367 | 0.335524 | 0.077832 | 0.283199 | 0.376532 |
| Acoustic Absorption Rate (3,270 Hz) | 0.993013 | 0.697653 | 0.369286 | 0.043496 | 0.259028 | 0.099883 |

From Table 1, it can be observed that, B3 has a larger diameter of hole and the highest opening rate, its acoustic absorption effect is obviously the worst in several different test conditions; B2, C1 both have higher opening rates and poorer acoustic absorption rates, but the acoustic absorption rate of B2 is still better than C1 due to its smaller diameter of hole; comparatively, A1, B1 both have smaller diameters of hole and lower opening rates, so the acoustic absorption rates thereof are significantly elevated, in particular A1 demonstrates the best acoustic absorption rate because of its smallest diameter of hole. Therefore, as the first critical factor, the opening of the acoustic board should be preferably less or equal to 0.04 $mm^2$.

Meanwhile, to fabricate micro through-holes with commonly available technologies, people mostly utilize the mould of multiple sharp tapered bodies to press down or punch in order to generate the acoustically absorptive micro-orifices having a corresponding diameter of hole or cross-sectional area on acoustic board materials. Unfortunately, as the diameter of hole getting smaller, the manufacture costs for the mould of tapered bodies may greatly soar, and, regarding to acoustically absorptive plate materials of higher hardness in particular, the mould may not be durable enough for long-term use, quickly worn off or even broken up, resulting in significant mould replacement costs. Moreover, it should be noticed that, upon pressing and piercing the acoustically absorptive plate materials with the tapered bodies, the sharper the tapered structure is, the more frequently burr structures may be created on the lateral side of the holes punched in the acoustic board, and such acoustically absorptive micro-orifices are so fine and tiny that subsequent modification or trimming operations may be very challenging; besides, these burr structures may also negatively influence the intended acoustic absorption effect thus reducing the yield of products. In addition, this machining approach may also further restrict the selections of available acoustically absorptive plate materials; i.e., thicker or harder decorative materials may have to be excluded from applicable options.

In prior art, some manufacturers considered to utilize plastic injection-molded technology to make acoustic boards; however, the design and fabrication for plastic injection moulds need to be configured depending on injection conditions, which means that the finer the acoustically absorptive micro-orifices are, the more delicate the moulds need to be, leading to higher difficulty in mould fabrication; and also, the mould stripping operation may cause damages to products, thus resulting in lowered product yield, increased costs, as well as undesirable restrictions to massive production.

Consequently, the present invention attempts to provide an acoustic board having displaced and passably abutted multiple through-holes, in which the piercing process needs not to be limited to conventional delicate moulds, but capable of applying moulds having greater diameters of hole for tooling operations, and then using a displacement process to allow the through-holes to be passably abutted thereby forming the intended acoustically absorptive micro-orifices. In this way, it is not only possible to lessen the abrasions in the moulds and reduce the costs, but eliminate burr structures potentially generated after the through-hole machining process; moreover, even slight burrs do appear, this issue may be easier to be resolved since the through-holes are wider, thus allowing the acoustic absorption effect thereof not to be affected by such burr issues on the acoustically absorptive micro-orifices.

Furthermore, it is also possible to apply the plastic injection technologies to allow the two moulds to be displaced and closely abutted such that the melted plastic gel may not easily leak in, thus successfully forming the acoustic holes of arbitrarily variable sizes; in this fashion, the mould of fine diameter may not break up upon mould stripping so as to reduce the mould manufacture costs, lower unnecessary mould losses and improve the yield of products.

SUMMARY OF THE INVENTION

An objective of the present invention is to provide an acoustic board having displaced and passably abutted multiple through-holes, which applies plate materials having through-holes to create acoustically absorptive micro-orifices with the displacement and passable abutment of the through-holes so as to reduce the requirement on the delicate tapered moulds thus lessening the manufacture costs of moulds.

Another objective of the present invention is to provide an acoustic board having displaced and passably abutted multiple through-holes, thus significantly reducing the mould abrasions by mutually stacking each of the plate materials having lessened thickness.

Yet another objective of the present invention is to provide an acoustic board having displaced and passably abutted multiple through-holes, so that the cross-sectional areas of the through-holes in the single layered plate material may be enlarged thereby greatly increasing the throughput performance in order to achieve the production of massive scales.

Still another objective of the present invention is to provide an acoustic board having displaced and passably abutted multiple through-holes, in which, due to greater cross-sectional area of the through-hole, it is more convenient to make modifications after piercing and the burr structure may be prevented thereby improving the product yield.

Further still another objective of the present invention is to provide an acoustic board having displaced and passably abutted multiple through-holes, in which, since the acoustically absorptive micro-orifices are formed by displacing and passably abutting the multiple through-holes, during installation and fabrication processes, it is possible to adjust the diameter of hole and the opening rate so as to increase the flexibility in use.

To achieve the aforementioned objectives, the present invention provides an acoustic board having displaced and passably abutted multiple through-holes, wherein the acoustic board has an outer surface and an inner surface opposite to the outer surface, characterized in that the acoustic board comprises: a plurality of first through-holes formed from the outer surface toward the inner surface; and a plurality of second through-holes formed from the inner surface toward the outer surface; and in which at least some of the second through-holes have a cross-sectional area of greater than 1 $mm^2$ and are displaced and passably abutted to at least some of the first through-holes, thereby conjunctively forming a plurality of acoustically absorptive micro-orifices having a cross-sectional area of smaller than 1 $mm^2$, and, compared with the total area of the acoustic board, the opening rate for the sum of the cross-sectional areas of all such acoustically absorptive micro-orifices is less than 3%.

From the above-said descriptions, it can be appreciated that the present invention discloses an acoustic board having displaced and passably abutted multiple through-holes, comprising an outer surface and an inner surface, in which the first through-holes formed from the outer surface toward the inner surface and the second through-holes formed from the inner surface toward the outer surface are displaced and passably abutted thereby conjunctively constituting acoustically absorptive micro-orifices. Herein the first through-holes and the second through-holes are not required to be pierced with delicate moulds, but simply using the plate materials having through-holes to create the structure of acoustically absorptive holes in a displaced and passably abutted approach. With the method according to the present invention, it is possible to not only simplify the mould structure, reduce mould abrasions, enhance the manufacture yield and throughput performance, lessen manufacture costs, but also increase the flexibility in use thereby integrally achieving all of the aforementioned objectives.

DETAILED DESCRIPTION OF THE ILLUSTRATED EMBODIMENTS

The aforementioned and other technical contents, aspects and effects in relation with the present invention can be clearly appreciated through the detailed descriptions concerning the preferred embodiments of the present invention in conjunction with the appended drawings; moreover, in each embodiment, the same components will be denoted with similar numbers.

Figure 1:
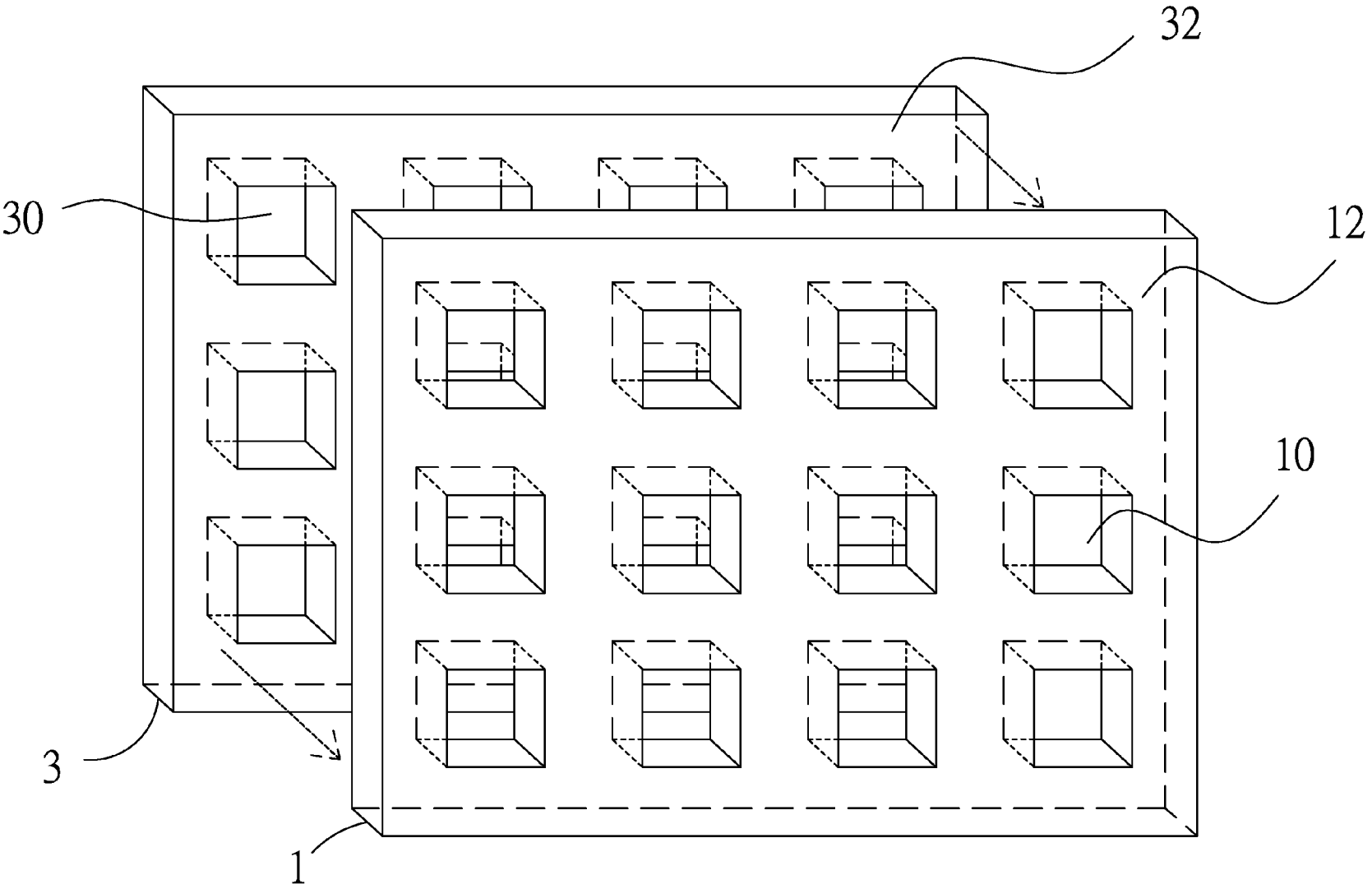
FIG. 1 shows an exploded view for a first preferred embodiment of the present invention, for illustrating the formation of acoustically absorptive micro-orifices by mutually displacing and passably abutting the first through-holes and the second through-holes.

Initially, the structure of a first preferred embodiment for the acoustic board having displaced and passably abutted multiple through-holes according to the present invention is shown in FIG. 1. To facilitate better understanding, herein the plate material exposed on most exterior side is referred as the surface plate material 1, while the plate material right behind the surface plate material 1 referred as the auxiliary plate material 3; however, those skilled ones in the art may conveniently appreciate that, in implementation, the surface plate material 1 and the auxiliary plate material 3 may be exactly identical.

In the present embodiment, the first through-holes 10 are formed on the surface plate material body 12 of the surface plate material 1 and the second through-holes 30 formed on the auxiliary plate material body 32 of the auxiliary plate material 3, respectively. As mentioned above, the shapes of the first through-holes 10 and the second through-holes 30 may be exactly the same, and also in the present embodiment, each of the first through-holes 10 and the second through-holes 30 is a square through-hole having a length of 1.2 mm on every side; that is, the cross-sectional area in each through-hole is 1.44 $mm^2$.

Figure 2:
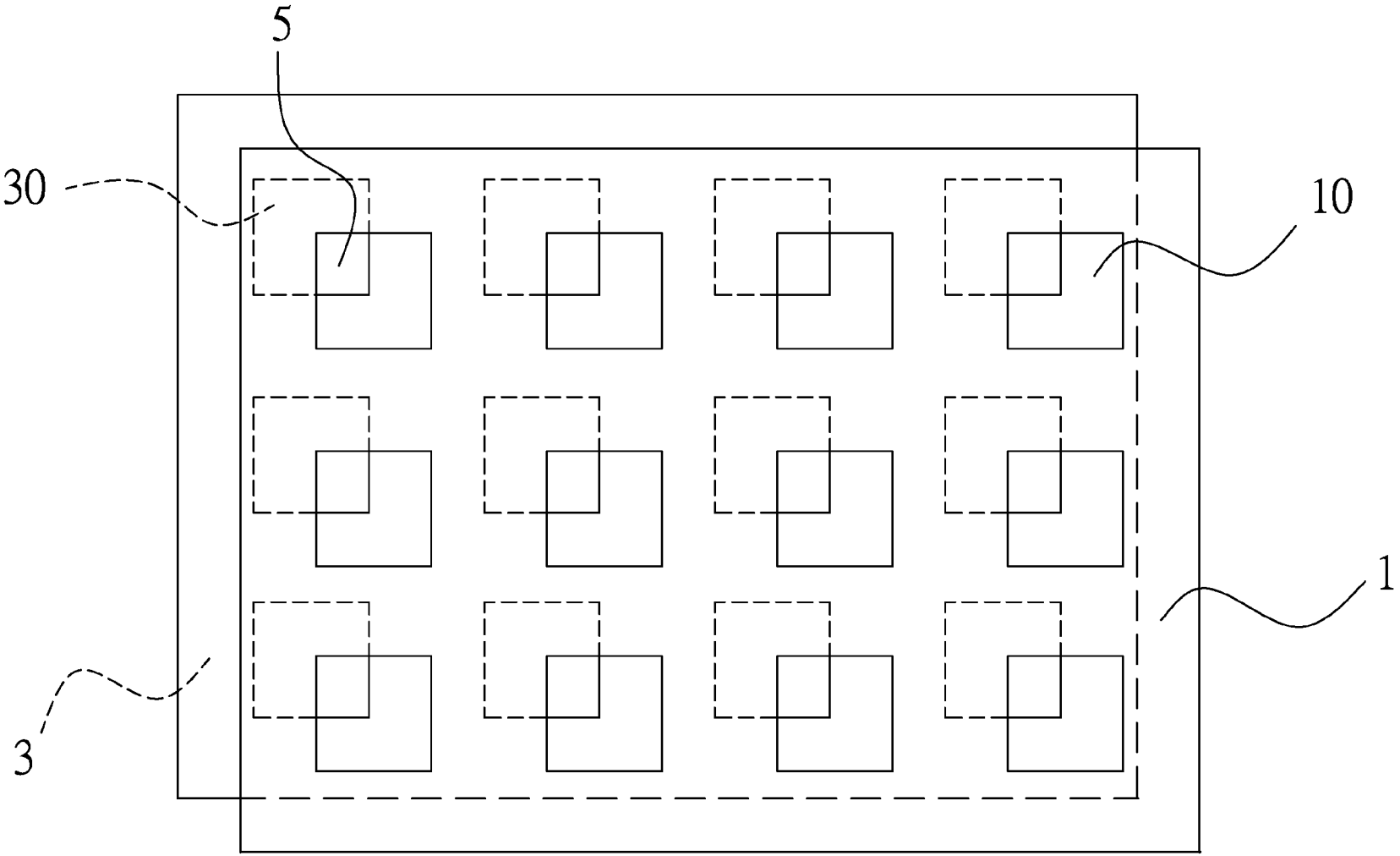
FIG. 2 shows a front view for the embodiment in FIG. 1 of the present invention, for illustrating the formation of acoustically absorptive micro-orifices by mutually displacing and passably abutting the first through-holes and the second through-holes.
Figure 3:
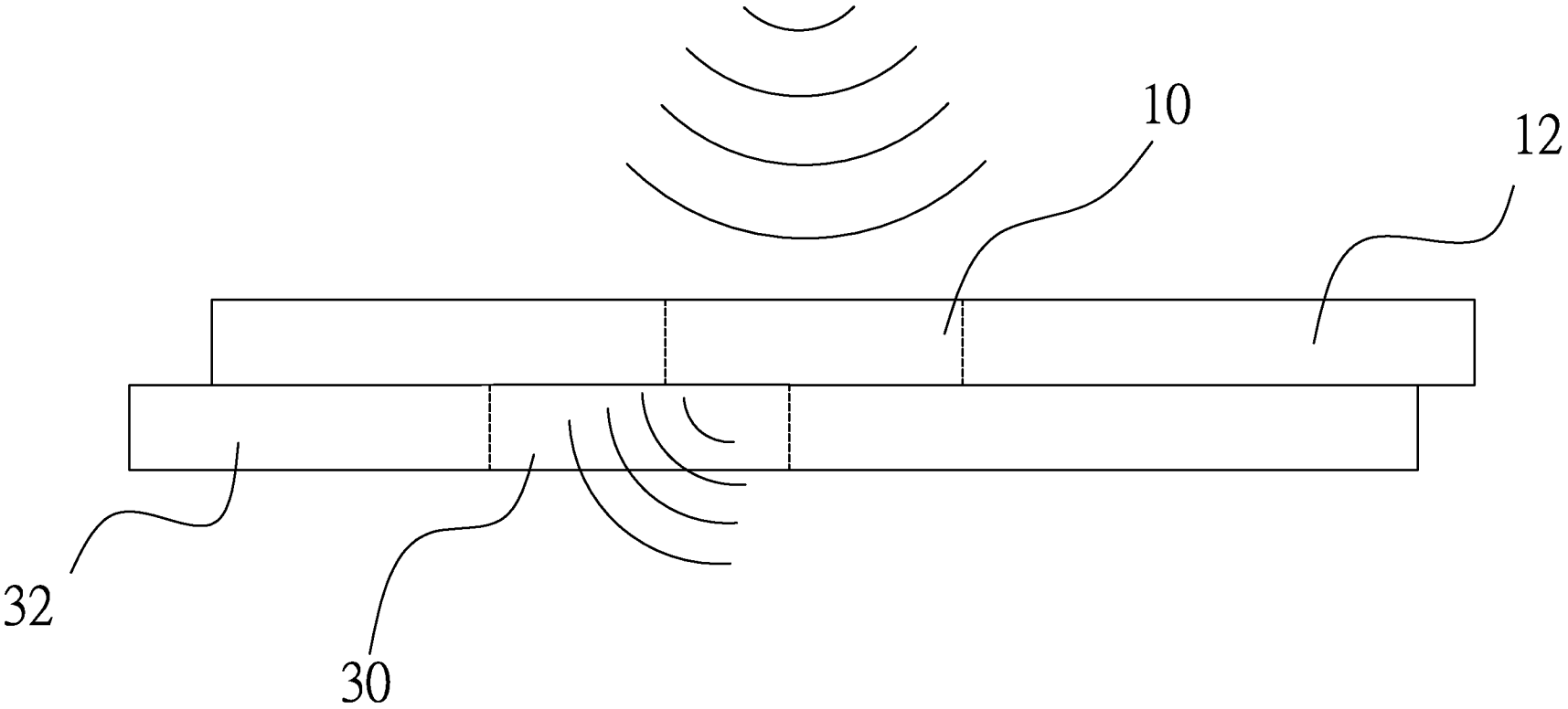
FIG. 3 shows a top view for the embodiment in FIG. 1 of the present invention, for illustrating the formation of acoustically absorptive micro-orifices by mutually displacing and passably abutting the first through-holes and the second through-holes.

Next, refer to FIGS. 2 and 3, wherein, during assemblage, the surface plate material 1 and the auxiliary plate material 3 are mutually displaced and overlapped such that the multiple first through-holes 10 and corresponding second through-holes 30 conjunctively constitute multiple acoustically absorptive micro-orifices 5, each of which having a cross-sectional area less or equal to 0.04 $mm^2$. No matter from beneath to look up or from above to look down, it can be seen that the first through-holes 10 and the second through-holes 30 are displaced with respect to each other in the present embodiment. To better understand, in the present invention, such a structural characteristic is defined as the first through-holes 10 and the second through-holes 30 being "displaced and passably abutted" thereby forming the acoustically absorptive micro-orifices 5, and the total cross-sectional area of all of such acoustically absorptive micro-orifices 5 takes up 1% of the entire acoustic board area.

As set forth previously, with currently available technologies, there are usually multiple sharp tapered bodies on the mould; suppose the through-holes to be formed on the plate material are designed to be excessively tiny, then, on one hand, the mould applied for hole piercing may be easily worn off during intensive punch processes, and, on the other hand, after piercing, burr profiles may be generated on the lateral side of such holes so that the edge of through-holes may become irregular thus adversely affecting the acoustic absorption affect thereof. On the contrary, since the cross-sectional areas in each of the first through-holes 10 and the second through-holes 30 may be configured to be several times or even several tens of times of the acoustically absorptive micro-orifices 5, in fabrication, it is not required to be restricted to delicate moulds thus greatly reducing the manufacture costs of moulds and significantly decreasing the abrasions on the mould.

Figure 4:
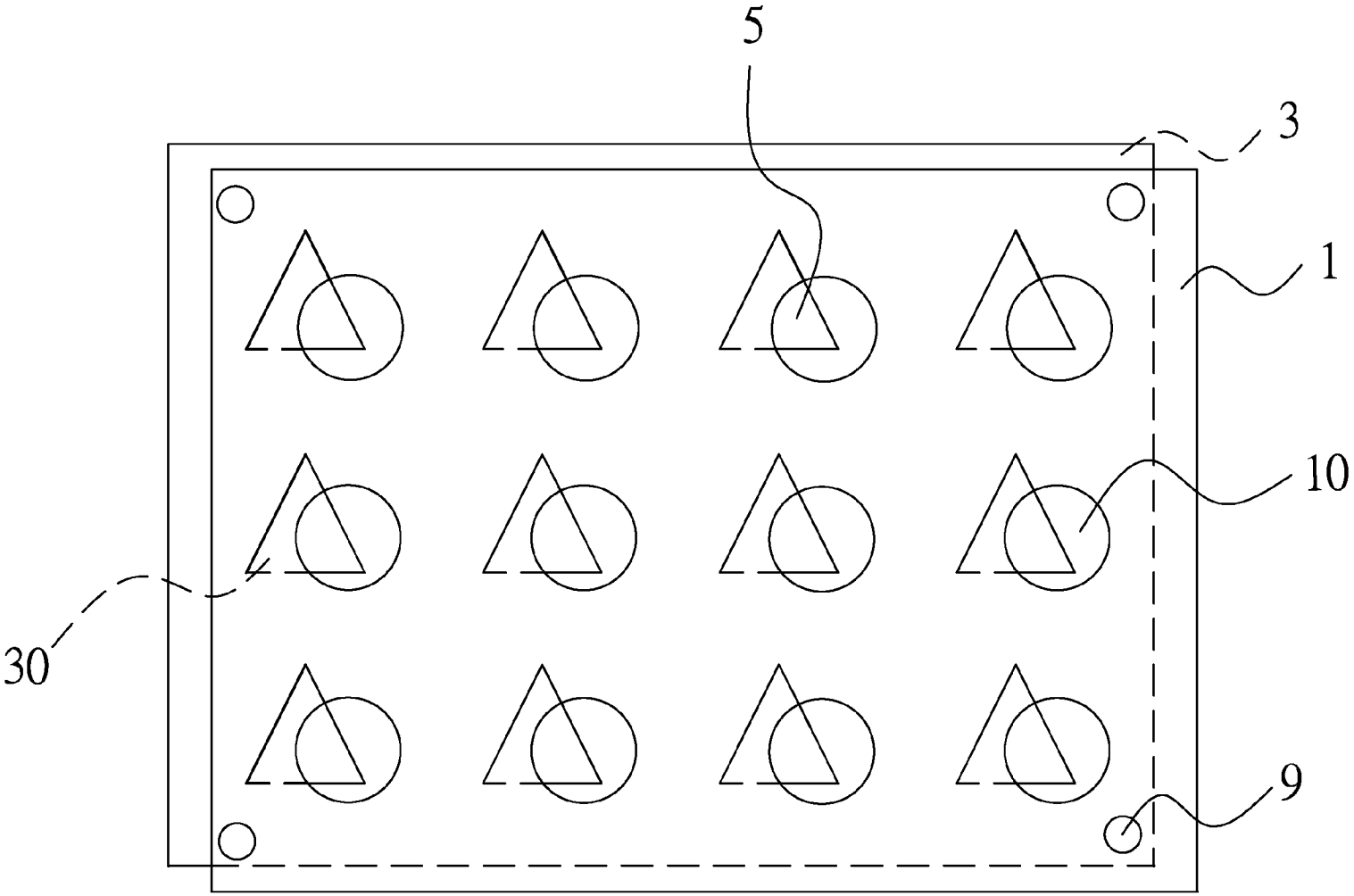
FIG. 4 shows a front view for the embodiment in FIG. 1 of the present invention, for illustrating the utilization of assembly parts to achieve close abutment between the plate materials.

The structure created through the machining operations can be shown in FIG. 4, wherein the present embodiment is assembled by means of displacement and overlap processes. First of all, a surface plate material 1 for assemblage as well as an auxiliary plate material 3 to be placed on the surface plate material 1 are provided, and an assembly part 9 is installed there between as the control device for the acoustically absorptive micro-orifices; in addition, the assembly part 9 is exemplified as a screw and a screw hole in the present embodiment. Moreover, the surface plate material 1 and the auxiliary plate material 3 are displaced and closely overlapped such that the first through-holes 10 and the second through-holes 30 respectively on such plate materials together can naturally create multiple acoustically absorptive micro-orifices 5. Of course, those skilled ones in the art can conveniently appreciate that, in addition to previously illustrated screw and screw hole, the assembly part may be magnets, latches, clips and grooves or the like.

According to in-situ tests performed by the Applicants, it is known that, in case the diameter of hole for the aforementioned through-holes is not greater than 0.2 mm, the acoustic absorption effect may be further improved; additionally, since the square holes are exemplified in the present embodiment, the length and width of the diameter of hole are both 0.2 mm, and the total cross-sectional area of the hole is 0.04 $mm^2$. However, even if the individual length and width of the first through-holes and second through-holes in the present embodiment are 0.5 mm, it is still possible to conveniently reduce the cross-sectional area of such acoustically absorptive micro-orifices down to 0.04 $mm^2$ or less in accordance with actual demands thereby enhancing the sound isolation effect and ensuring living quality.

Furthermore, such plate materials having through-holes need only displacement and overlap operations to create the intended acoustically absorptive micro-orifices. In comparison with prior art, the method according to the present invention may largely decrease the difficulty in the fabrication of acoustically absorptive micro-orifices, thus improving the product yield to a significant extent. Besides, since the cross-sectional area of the plate material having through-holes is greater, it is more convenient to modify after piercing operations with less burr structures left thereon, thus further ameliorating its acoustic absorption effect. Meanwhile, during the assemblage of the plate materials having through-holes, it is also possible to adjust the diameters of hole and opening rates based on user's and environmental requirements such that, in comparison with the total area of the entire acoustic board, the opening rate for the sum of the cross-sectional areas of all acoustically absorptive micro-orifices may be less than 3%, thereby increasing the flexibility in use and maintaining good acoustic absorption effect. At the same time, those skilled ones in the art can also consider to form the acoustic board having acoustically absorptive micro-orifices through an approach of three-layered or multi-layered through-hole plate material displacement and passable abutment, or else optionally with thicker or harder decorative materials, such that the acoustic board structure disclosed according to the present invention may be more flexible in application.

Figure 5:
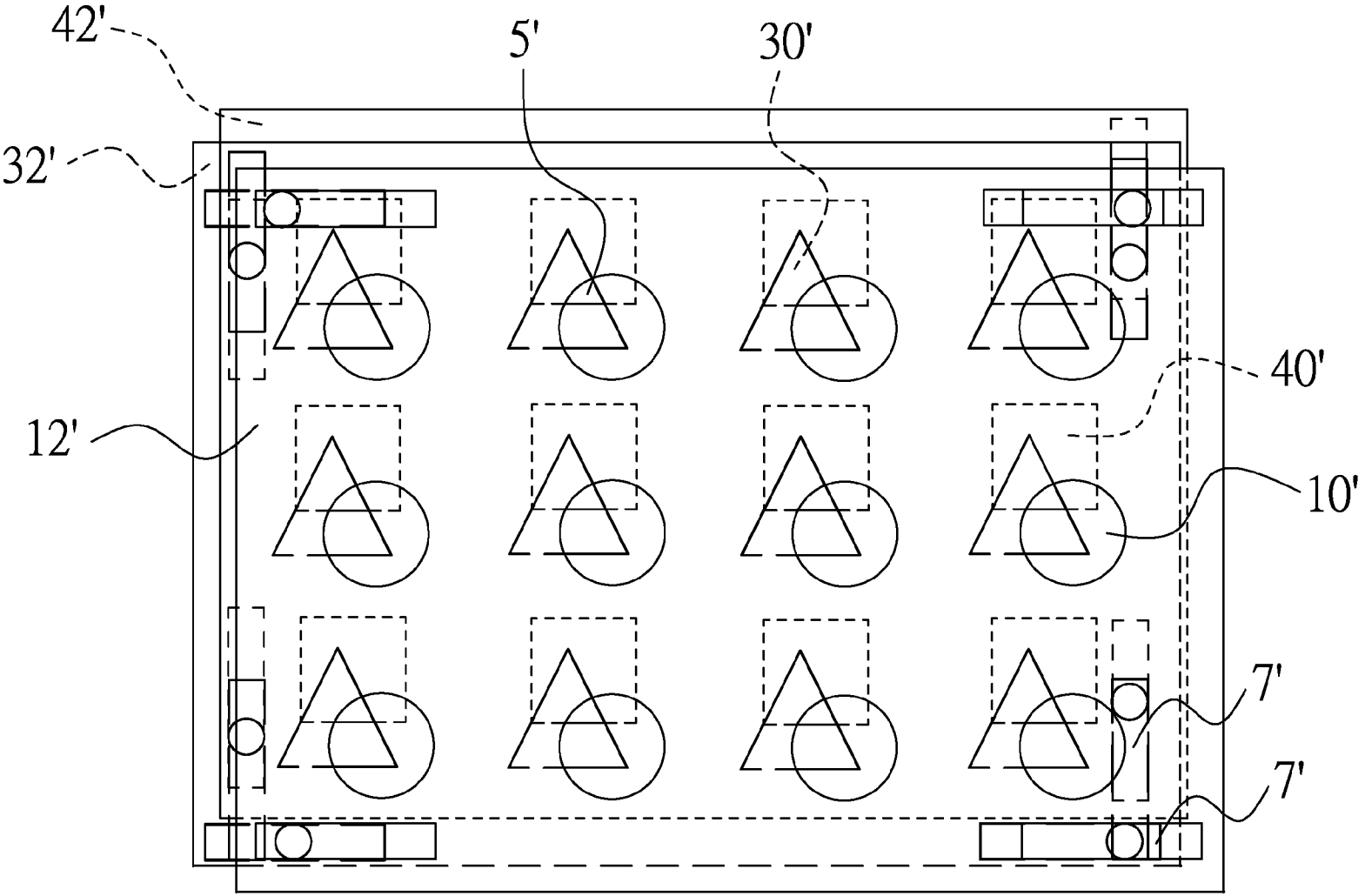
FIG. 5 shows a front view for a second preferred embodiment of the present invention, in which, using the sliding feature of slide grooves, the bodies of the plate materials are displaced, closely overlapped and passably abutted to form acoustically absorptive micro-orifices.

Next, a second preferred embodiment of the present invention will be described, in which the aforementioned structure can be utilized from the above-said fixed mode to a slide mode. As shown in FIG. 5, in the second preferred embodiment of the present invention, on the adjacent surface plate material body 12' and the auxiliary plate material body 32', or further on the adjacent corresponding plate material body 42', there respectively form mutually vertical slide grooves and the fixation bolts exemplified as screw bolts which sequentially penetrate through the first through-hole 10' on the surface plate material body 12', second through-hole 30' on the auxiliary plate material body 32' and third through-hole 40' on the corresponding plate material body 42', such that the through-holes on the plate materials are passably abutted thereby forming acoustically absorptive micro-orifices 5' having a suitable size, and that these plate materials are displaced and closely abutted in order to prevent possible slits between them due to slide and assemblage operations. Certainly, those skilled ones in the art can conveniently appreciate that, even if the aforementioned slide groove structure is not employed, other appropriate structures may still fall within the scope of implementation in accordance with the present invention. Besides, it should be noticed that, the surface plate material body 12', the auxiliary plate material body 32' and the corresponding plate material body 42' set forth earlier do not follow any fixed installation sequence or order, but may be freely customized based on actual demands.

Figure 6:
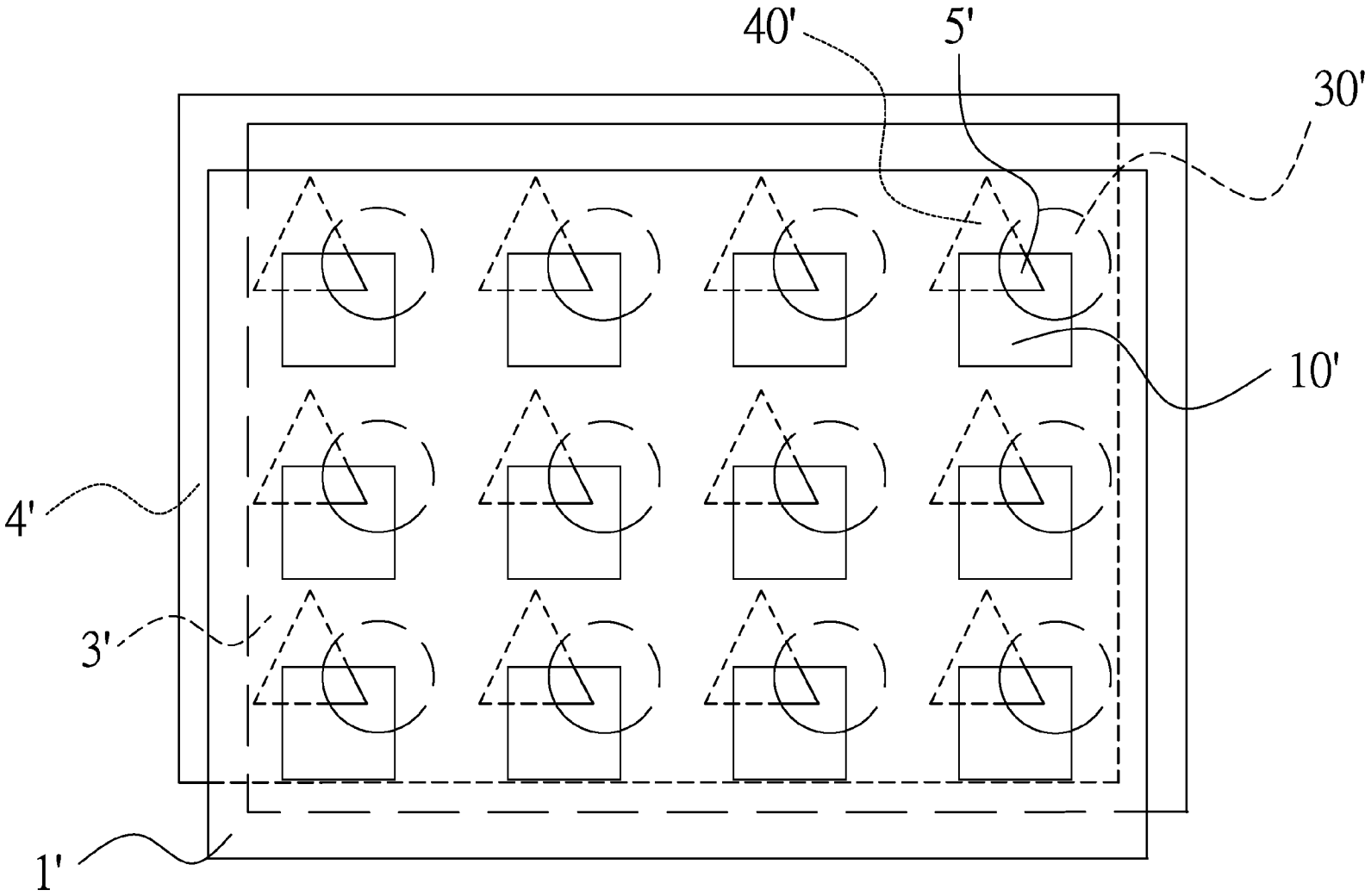
FIG. 6 shows a front view for the embodiment in FIG. 5 of the present invention, for illustrating the formation of acoustically absorptive micro-orifices by mutually displacing and passably abutting the first through-holes, the second through-holes and the third through-holes of various shapes.

Moreover, the shapes between such plate materials may vary according to various requirements, as illustrated in FIG. 6. In the present instance, the shapes of the first through-holes 10' on the surface plate material 1', the second through-holes 30' on the auxiliary plate material 3' and the third through-holes 40' on the corresponding plate material 4' may respectively differ, so long as the cross-sectional area of the acoustically absorptive micro-orifice formed by displacement and passable abutment of the through-holes there between is smaller or equal to 0.04 $mm^2$, it is then possible to create suitable acoustically absorptive micro-orifices 5' and achieve the same effect.

Figure 7:
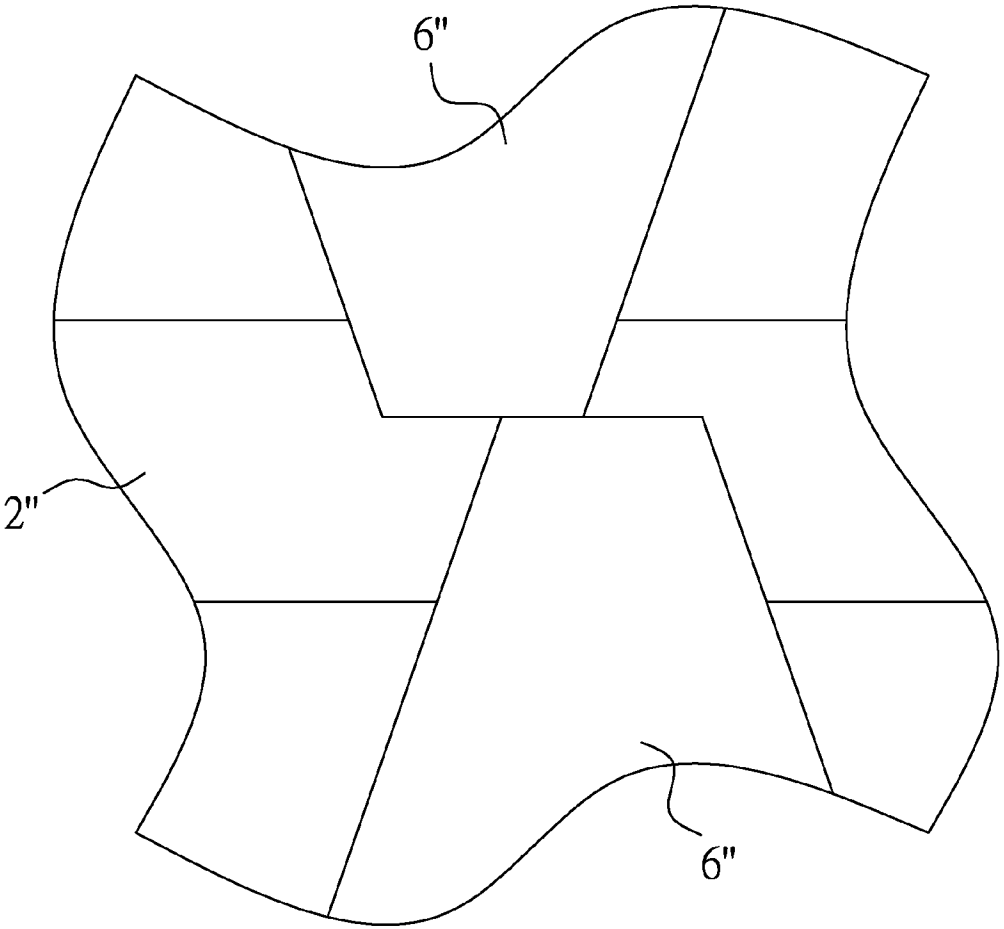
FIG. 7 shows a lateral view for a third preferred embodiment of the present invention, for illustrating the injection-molded and integrally formed structure of the acoustic board having displaced and passably abutted multiple through-holes.
Figure 8:
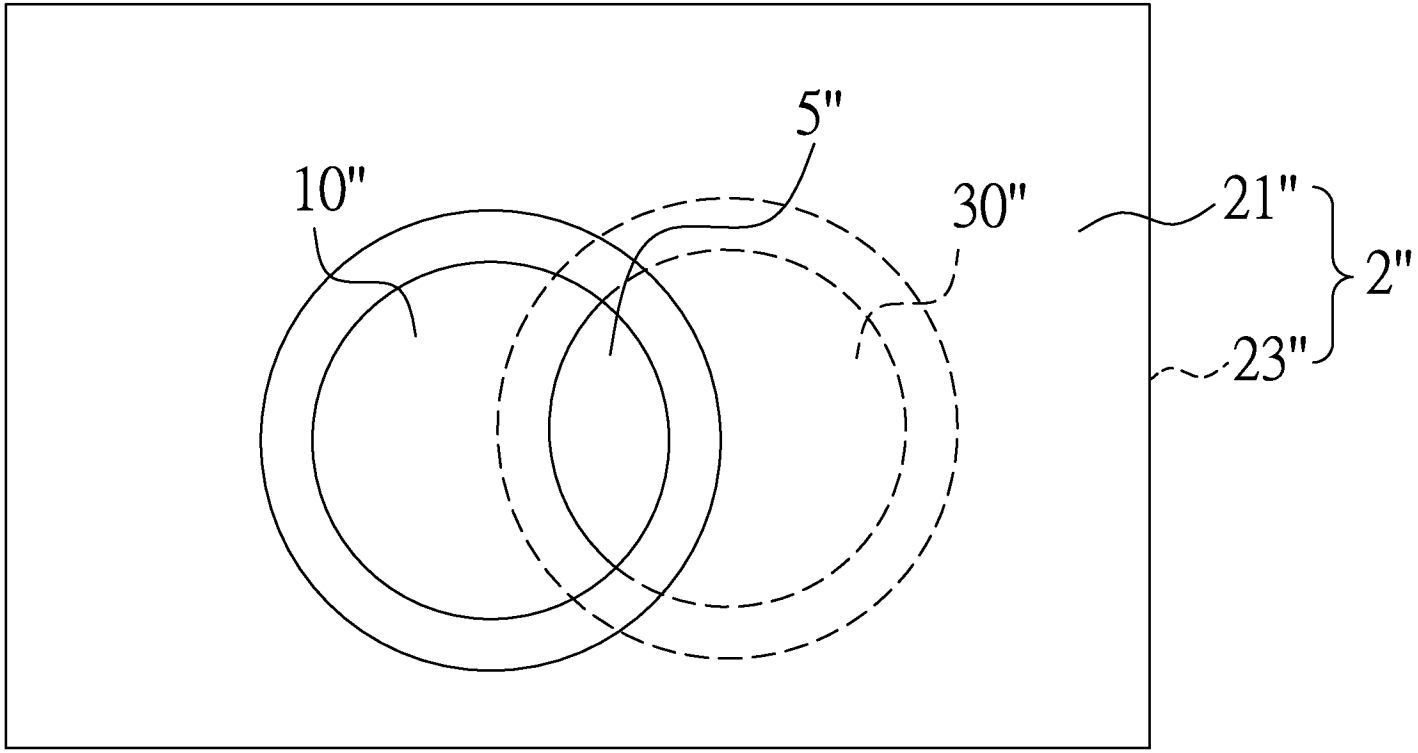
FIG. 8 shows a top view for the embodiment in FIG. 7 of the present invention, for illustrating the displacement and close abutment of two moulds thereby displacing and passably abutting the first through-holes and the second through-holes to form acoustically absorptive micro-orifices.

In addition, by applying plastic injection technologies, it is possible to further lessen abrasion on the pressing mould and reduce the complexity in plate material assemblage processes. As such, a third preferred embodiment of the present invention is provided, as referred to FIGS. 7 and 8. In the present embodiment, a body 2" formed by means of the plastic injection molding technology is provides, in which the body 2" is fabricated by first displacing and closely abutting two moulds 6", pressing and injecting melted plastic into a pre-configured machine, and then, after cooling, opening the moulds and taking out the finished plastic product. To facilitate better understanding, herein the most exterior side is referred as the outer surface 21", while the other side with respect to the outer surface 21" referred as the inner surface 23"; additionally, the first through-holes 10" are formed from the outer surface 21" toward the inner surface 23", and the second through-holes 30" formed from the inner surface 23" toward the outer surface 21". Herein the first through-holes 10", second through-holes 30" as well as acoustically absorptive micro-orifices 5" created by displacement and passable abutment processes are integrally formed; also, the radii of the aforementioned first through-holes 10" and second through-holes 30" are all 1 mm, meaning the minimum cross-sectional area in each of the through-holes is approximately 3.14 $mm^2$, but, after displacement and passable abutment, it is still very easy to restrict the cross-sectional areas of such acoustically absorptive micro-orifices 5" to 1 $mm^2$, and the opening rate of the total cross-sectional area thereof with respect to the area of the above-said acoustic board will not be greater than 3%.

However, it should be appreciated that the descriptions set forth as above all illustrate simply the preferred embodiments of the present invention, rather than restricting the implementation scope of the present invention thereto. That is, all convenient and equivalently effective changes and modifications made in accordance with the following claims and the contents in the aforementioned specification of the present invention, such as adding certain decorative holes having a cross-sectional area of greater than 1 $mm^2$ or of various sizes or shapes on the acoustic board, should be all considered to be within the coverage of the present invention.

What is claimed is:

1. An acoustic board having displaced and passably abutted multiple through-holes, wherein the acoustic board has an outer surface and an inner surface opposite to the outer surface, characterized in that the acoustic board comprises:

a plurality of first through-holes formed from the outer surface toward the inner surface; and a plurality of second through-holes formed from the inner surface toward the outer surface; and in which at least some of the second through-holes have a cross-sectional area of greater than 1 $mm^2$ and are displaced and passably abutted to at least some of the first through-holes, thereby conjunctively forming a plurality of acoustically absorptive micro-orifices having a cross-sectional area of smaller than 1 $mm^2$, and, in comparison with the total area of the acoustic board, the opening rate for the sum of the cross-sectional areas of all such acoustically absorptive micro-orifices is less than 3%, each first through-hole has a first conical shape with a first opening and a second opening, the first opening has a diameter greater than a diameter greater of the second opening, the first opening abutting the outer surface, each second through-hole has a second conical shape with a third opening and a fourth opening, the third opening has a diameter greater than a diameter greater of the fourth opening, the third opening abutting the inner surface, and the second opening of a first through-hole abuts partially the fourth opening of a second through-hole and results in a resulting through-hole with a diameter smaller than the diameter of the second opening and the diameter of the fourth opening.

2. The acoustic board having displaced and passably abutted multiple through-holes according to claim 1, characterized in that the acoustic board comprises a surface plate material and an auxiliary plate material, in which the surface plate material has the outer surface and the first through-holes, the auxiliary plate material has the inner surface and the second through-holes, and the surface plate material and the auxiliary plate material are mutually abutted for combination.

3. The acoustic board having displaced and passably abutted multiple through-holes according to claim 2, characterized in that the acoustic board further comprises at least a correspondence plate material, in which the correspondence plate materials respectively have a plurality of third through-holes and at least one of such correspondence plate materials is abutted and combined to the inner surface of the auxiliary plate material such that at least some of the third through-holes are displaced and passably abutted to the acoustically absorptive micro-orifices.

4. The acoustic board having displaced and passably abutted multiple through-holes according to claim 1, characterized in that the acoustic board further comprises an assembly part thereby enabling the mutual abutment and overlap of the surface plate material and the auxiliary plate material for assemblage.

5. The acoustic board having displaced and passably abutted multiple through-holes according to claim 4, characterized in that the assembly part further includes a plurality of slide grooves formed on the surface plate material and the auxiliary plate material, and a plurality of fixation bolts allowing penetration through the slide grooves, thereby enabling relative slide when the surface plate material is overlapped in combination to the first auxiliary plate material closely abutted to the surface plate material.

6. The acoustic board having displaced and passably abutted multiple through-holes according to claim 1, characterized in that the acoustic board comprises an injection-molded body, and the body is integrally formed with the first through-holes and the second through-holes.

7. The acoustic board having displaced and passably abutted multiple through-holes according to claim 1, characterized in that the first through-holes and the second through-holes have the same shape.

8. The acoustic board having displaced and passably abutted multiple through-holes according to claim 1, characterized in that the first through-holes and the second through-holes have different shape.

9. The acoustic board having displaced and passably abutted multiple through-holes according to claim 1, characterized in that the opening rate is less than 1%.

10. The acoustic board having displaced and passably abutted multiple through-holes according to claim 1, characterized in that the cross-sectional area of the acoustically absorptive micro-orifices is less than 0.04 $mm^2$.

* * * * *